US006769999B1

(12) United States Patent
Chase

(10) Patent No.: US 6,769,999 B1
(45) Date of Patent: Aug. 3, 2004

(54) REUSEABLE DIRECTIONAL GOLF TEE APPARATUS AND METHOD

(76) Inventor: Raymond Francis Chase, 1875 Jeanine Way, Hellertown, PA (US) 18055

( * ) Notice: Subject to any disclaimer, the term of this patent is extended or adjusted under 35 U.S.C. 154(b) by 0 days.

(21) Appl. No.: 10/616,029

(22) Filed: Jul. 9, 2003

Related U.S. Application Data

(60) Provisional application No. 60/444,785, filed on Feb. 4, 2003.

(51) Int. Cl.[7] ..... A63B 69/36
(52) U.S. Cl. ..... 473/386; 473/257
(58) Field of Search ..... 473/386–403, 473/257, 278; D21/717, 718

(56) References Cited

U.S. PATENT DOCUMENTS 1,596,110 A * 8/1926 Lynch ..... 473/387
2,128,049 A * 8/1938 Karkoska ..... 473/387
3,883,144 A * 5/1975 Lazow ..... 473/398
4,181,300 A * 1/1980 Bradley ..... 473/257
5,240,254 A * 8/1993 Adlam ..... 473/257
5,437,448 A * 8/1995 Balson ..... 473/257
5,482,284 A 1/1996 Vandever

* cited by examiner

*Primary Examiner*—Steven Wong
(74) *Attorney, Agent, or Firm*—Dorothy S. Morse

(57) ABSTRACT

A reusable compact device having a T-shaped plate with a tapering end, a cross member end, a central aperture, and a darkened perpendicular line between the aperture and cross member. When the golfer places the plate at ground level, points its tapering end toward the desired flight path of his/her ball, inserts a tee through the aperture and partially into the ground, places a golf ball upon the tee, self-aligns with the plate's tapering end, aligns the club face with the plate's cross member, and centers the club face to the exact ball center using the darkened perpendicular line, the golfer does not have to look up, position and stance are not lost during the swing, and the resulting swing is straightened, with improved accuracy and consistency in launching a golf ball along an intended flight path. Optionally, grooved tees are used to adjust ball height according to club type.

20 Claims, 2 Drawing Sheets

REUSEABLE DIRECTIONAL GOLF TEE APPARATUS AND METHOD

CROSS-REFERENCES TO RELATED APPLICATIONS

This patent application is based upon U.S. provisional patent application Ser. No. 60/444,785 filed by the same inventor on Feb. 4, 2003, and claims all priority and benefit available therefrom.

BACKGROUND

1. Field of the Invention

This invention relates to golf tee setters and holders, specifically to a simple and compact reusable device having a three-fold purpose, first to align a golfer to the desired flight path of his or her golf ball, second to position the face of the golfer's club to the intended direction of the ball, and third to enable the golfer to place his/her club head or face at the exact center of the golf ball during club/ball contact. Its use can benefit all golfers by helping them to visualize the position they must take in addressing and striking a golf ball to obtain greater distance and accuracy in launching the ball along a desired flight path. The present invention comprises a substantially T-shaped plate that is used at ground level with its cross member at one of its ends, one centrally located aperture therethrough that is sized and configured for insertion of a golf tee, and the end remote from its cross member having a configuration that tapers to a point. In addition, a darkened substantially perpendicular line extends from the aperture to the center of the cross member, for use by the golfer in positioning his/her club face to the exact center of the golf ball for a center strike of the golf ball at the time of club/ball contact and greater distance and accuracy of the ball once struck. Although not limited thereto, the maximum length and width dimensions of the plate are typically three inches or less. Also, during use the plate is placed on the ground at a spaced-apart distance in front of the golfer's feet with the central aperture positioned under the anticipated point of contact between the ball and the face of the golfer's club. Subsequently, the plate is situated into its usable position with its tapered end directed toward the intended flight path of the golf ball ultimately supported thereby, a golf tee is inserted through the plate's aperture and partially into the ground below the plate, and a golf ball is balanced upon the top surface of the tee at a spaced apart distance above the upper surface of the plate. As the golfer addresses the ball prior to striking it, he or she is positioned to face one of the sides of the plate, not its pointed end or its cross member, with the pointed end of the plate being directed toward the intended flight path of the golf ball and the cross member oriented toward the direction from which the club will be swung so that the golfer can use the cross member to align the face of the golf club prior to the golfer's swing, with the darkened line extending from the aperture to the center of the cross member giving the golfer exact center of the golf ball as a reference for club face positioning. Thus, once the plate is properly positioned at ground level, the golfer is able to rely on the tapered end, cross member, and the darkened perpendicular line between the aperture and the cross member, for directional assistance in self-alignment relative to the desired flight path of his or her golf ball and positioning of the golfer's club face to the intended direction of ball movement for accurate launching of the ball along an intended flight path. Since the golfer does not have to look up prior to the swing, the golfer's position and stance are not compromised during the swing, resulting in a straightened swing that is more consistent in launching a golf ball through the desired flight path. Further, since the present invention is compact in size, typically having length and width dimensions three inches or less, it can easily be stored in a clothing pocket or golf bag between uses. Although standard tees can be used with the present invention and adjusted in height for use with different types of clubs, other tees can also be used, such as a tee having added length dimension that provides more options in ball height adjustment, as well as a tee with several spaced-apart laterally-extending grooves on its shaft that are configured to engage the aperture in the present invention plate and thereby fix the grooved tee at several pre-determined heights, with each groove being designated for ball contact with a different type of club so that a center strike of the launched golf ball can be more consistently achieved, producing more even ball recoil and a more predictable shot. The size of golf tee used is therefore selected according to user preference, however, the suggested minimum size is approximately two-and-one-fourth inches, or fifty-five millimeters.

2. Description of the Related Art

Good performance in golf demands consistency from the golfer, and many golfers seek aids to improve stance, swing, and ball contact during practice and games. Often, such devices are complex and expensive to use. In contrast, the present invention is simple in design, easy to use, compact, effective, and can be manufactured and sold for a reasonable cost. Further, when not in use, it is small enough to be conveniently stored in a clothing pocket or a golf bag, where it can be readily accessed for immediate use as often as needed.

The device thought to be closest to the present invention is the invention disclosed in U.S. Pat. 5,482,284 to Vandever (1996). The Vandever invention and the present invention are both golf training and practice devices that assist a golfer in more accurately determining the flight path of a golf ball. However, there are important differences between the Vandever invention and the present invention. The Vandever invention comprises two major parts. The first part has four evenly spaced apart pointers extending from a central hub. One of the pointers extends rearwardly toward the golfer. Another pointer extends in the opposite direction toward the ball, and the remaining two pointers extend laterally relative to the golfer, respectively extending in the direction of the intended flight path of the golf ball once it is struck and in the opposed direction from which the golf ball is to be struck. Each of the golfer's feet are positioned on a different side of the pointer that extends rearwardly toward the golfer, with both feet remaining behind the laterally extending pointers in a position remote from the ball. The second part of the Vandever invention is an alignment member that assists the golfer in angling the face of the club for optimal club/ball contact. The alignment member is attached to the one of the pointers extending toward the ball. In contrast, the present invention is less complex in design and has a unitary construction. No time is required to assemble the present invention prior to use, as it is employed without assembly. Also, when using the Vandever invention, the golf ball to be struck is positioned at the end of a pointer. In contrast, with the present invention, the golf ball to be struck is balanced on a tee above its centrally located aperture. Another difference between the present invention and the Vandever invention is that the portion of the present invention providing flight path directional assistance to a golfer is the end that tapers to a point, while in the Vandever invention the laterally extending pointer is aimed toward the intended flight path of the ball. Also, the alignment portion of the Vandever invention is a separate component that is attached to the forwardly extending pointer and during use is positioned between the ball and the laterally-extending pointer employed as its flight path directional aid. In the present invention the cross member is used for such club face alignment. In addition, the present invention is smaller than the Vandever invention, simpler to use, does not require assembly, and is less expensive to manufacture. No golf tee holder and directional aid is known to have the same structure or all of the advantages of the present invention.

BRIEF SUMMARY OF INVENTION

It is the primary object of this invention to provide a compact and easy-to-use reusable device upon which a golfer can rely for effective directional assistance in striking a golf ball balanced upon a tee. It is also an object of this invention to provide a device which that prevents a golfer from having to look up prior to or during the initial stages of a swing so that his or her position and stance are not lost, and whereby a straightened swing is achieved that is more accurate and consistent in launching a golf ball through an intended flight path. It is a further object of this invention to provide a directional tee apparatus that ensures a steady swing of a golf club prior to club/ball contact and prevents premature wrist hinge. A further object of this invention is to provide a directional tee apparatus that is suitable for use by all golfers. It is also an object of this invention to provide a directional tee apparatus that is able to adjust ball height. It is also an object of this invention to provide a directional tee apparatus that can be used with standard golf tees, tees having added length dimension, as well as grooved tees that are adapted to provide pre-determined increments of ball height adjustment. It is a further object of this invention to provide a directional tee apparatus that is lightweight for easy transport and storage between uses. A further object of this invention is to provide a directional tee apparatus that is made from durable materials and requires little or no maintenance between uses. It is a further object of this invention to provide a directional tee apparatus that is simple in design for cost effective manufacture.

As described herein, properly manufactured, and used at ground level to position a golf ball relative to a golfer, prior to club/ball contact and ball launch into a desired flight path, the present invention provides golfers with a means for straightening their swings when striking the ball, and assistance in positioning their club faces directly in the exact center of the golf ball during club/ball contact that results in a more predictable shot. The present invention can be repeatedly used during practice or during a game, and can provide assistance to golfers of all experience and skill levels by helping them to visualize the position they must take in addressing and striking a ball to obtain an intended flight path of the struck ball with greater accuracy. Further, by channeling the forward motion of the club, it corrects inaccuracies in a golfer's swing. Since the present invention is compact and placed at ground level under the ball, with the outer vertical surface of the cross member being used to align the face of the golfer's club, the perpendicular line between the central aperture cross member being used to place the club face in the direct center of the golf ball during club/face contact, and the pointed end providing directional assistance to the golfer for self-alignment, with the pointed end, perpendicular line, and cross member all being in close visual proximity to the ball and the adjacent club head prior to the swing, the golfer can concentrate on his/her swing without having to look up, allowing the golfer's position and stance to remain uncompromised during the swing and resulting in a straightened swing that is more consistent in launching a golf ball through a desired flight path. During use, the present invention always stays at ground level, with the ball to be struck balanced on a tee inserted through its plate's central aperture and into the ground. Further, the present invention is simple and efficient to use, since it has a unitary construction and there is no complex set-up prior to use or dismantling between uses. The simple configuration also makes it cost effective to manufacture. Ease in transport between uses is facilitated by its small size, typically having maximum length and width dimensions that are three inches or less, as well as the capability of the present invention to be manufactured from lightweight materials such as plastic. Further, the materials from which it is made are preferably durable for repeated reuse and selected so that little or no maintenance is required between uses. Before the present invention is employed with a golf ball in play, the golfer needs to determine the desired flight path for the ball and select an appropriate ground location relative to that flight path for placing the present invention. The plate's aperture is centered upon the selected location and the pointed end of the plate is then aimed in the direction of the desired flight path. A tee is then inserted through the central aperture of the plate and partially into the ground, after which the golf ball to be launched is balanced upon the top surface of the tee. Any type of tee can be used, including those with grooves for ball height adjustment at predetermined increments and those having a longer shaft than standard size tees. However, a tee that having a length of at least two-and-one-fourth inches is preferred. Use of the cross member of the present invention to align the golfer's club ensures a confident and steady swing, and prevents premature wrist hinge. The darkened perpendicular line on the surface of the T-shaped plate between the aperture and the cross member can then be used to position the club face to the exact center of the golf ball. Informational markings in the form of instructions for present invention use may also assist the golfer in orientation of the present invention device, as well as orientation of the golf club face with the cross member for assistance in obtaining a center strike of the intended golf ball when the golf club is ultimately swung.

While the description herein provides preferred embodiments of the present invention, it should not be used to limit its scope. For example, variations of the present invention, while not shown and described herein, can also be considered within the scope of the present invention, such as variations in the length and width dimensions of the main body of the plate between its pointed end and the cross member, the length and width dimensions of the cross member, the thickness dimension of the plate, the size of the acute angle created by the pointed end, and the number and type of informational markings used, if any. Thus, the scope of the present invention should be determined by the appended claims and their legal equivalents, rather than being limited to the examples given.

DETAILED DESCRIPTION OF THE INVENTION

Figure 1:
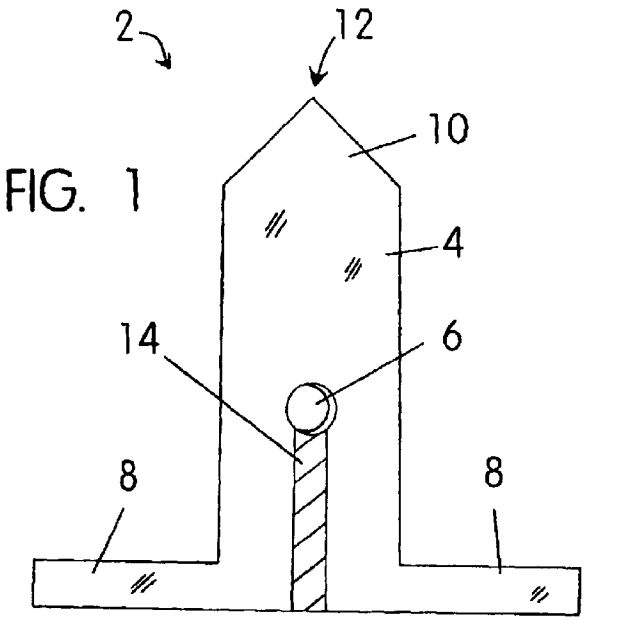
FIG. 1 is a top view of the most preferred embodiment of the present invention having a substantially planar plate with a substantially T-shaped configuration, an aperture centrally though the plate, the cross member of the T-shaped configuration on one of the ends of the plate, the pointed end of the plate in a position opposed to its cross member, and a darkened perpendicular line extending between the aperture and the cross member.
Figure 7:
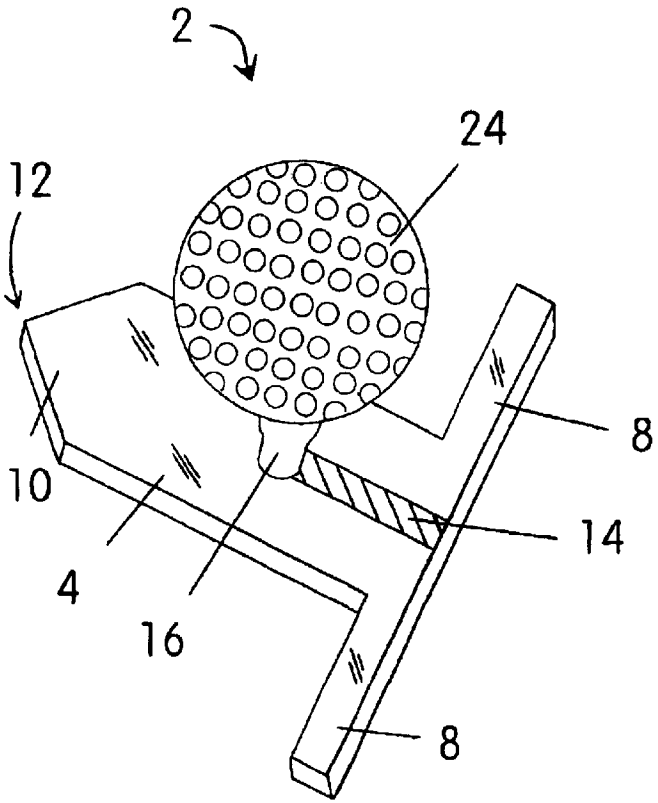
FIG. 7 is a perspective view of the most preferred embodiment of the present invention with a golf tee inserted through a central aperture in its plate and extending upwardly beyond the upper surface of the plate, a golf ball balanced upon the top surface of the golf tee, and a darkened line extending between the cross member and the aperture that is substantially perpendicular to the cross member.

FIG. 1 shows the most preferred embodiment of the present invention having a plate 2 with substantially planar and T-shaped configurations. Plate 2 is used at ground level. Its main body 4 is adjacent to a cross member 8 that creates the T-shaped configuration at one of plate 2, with a pointed end 12 adjacent to a tapered area 10 and in a position opposed from cross member 8. FIG. 1 shows main body 4, cross member 8, and tapered area 10 all having a unitary construction, with cross member 8 and tapered area 10 each seamlessly depending from main body 4. A unitary molded construction is preferred, although not critical. Further, it is contemplated for plate 2 to be sufficiently small that a golfer (not shown) can easily hold it in one hand, with the dimensions of plate 2 also allowing for easy transport of plate 2 in a clothing pocket or golf bag (not shown) when it is not being used. One example of size dimensions that would allow such ease in manipulation of the present invention, although not limited thereto, would be when its preferred length dimension is approximately two-and-three-fourths inches, its preferred width dimension is approximately three inches (with main body 4 having a width dimension of approximately one inch and each end of cross member 8 extending approximately 8 one inch beyond main body 4), and its preferred thickness dimension is approximately one-fourth of an inch. Also, for durability and practically maintenance-free use, although not limited thereto, it is preferred for plate 2 to be made from virtually unbreakable plastic materials. FIG. 1 further shows a central aperture 6 laterally centered through main body 4 between pointed end 12 and cross member 8. Aperture 6 would be a snug fit to any golf tee used, such as but not limited to a standard golf tee or the spaced groove snap golf tee 16 shown in FIG. 4. Although FIG. 1 shows aperture 6 as being substantially round for ease in insertion and removal of the substantially shaft of the golf tee 16 shown in FIG. 4, or other standard golf tee used, the round configuration is not critical, and should golf tee shafts having other configurations ever be made, main bodies 4 could also be made with aperture 6 configurations adapted for use therewith. As shown in FIG. 7, during use of plate 2 the upper portion of tee 16 remains raised above the top surface of main body 4. For better support of a golf ball, such as golf ball 24 shown in FIGS. 6 and 7, at the moment of club/ball impact it is preferred that aperture 6 be substantially centered laterally within main body 4. However, the distance between aperture 6 and pointed end 12 could be varied, as long as aperture 6 is not positioned so close to pointed end 12 that would cause a golf ball 20 balanced upon the tee 16 within aperture 6 to obscure the directional aid provided by pointed end 12. In using the length and width dimensions for plate 2 provided above of approximately two-and-three-fourths inches and approximately three inches, respectively, FIG. 1 shows the center of aperture 6 being positioned approximately one-and-eleven-sixteenth inches from pointed end 12. Further, it is contemplated for the diameter of aperture 6 to be sufficiently large for easy insertion of a golf tee 16 therethrough, but at the same time allowing a minimum of lateral movement for tee 16 when it is in its usable position within aperture 6 and ready for support of a golf ball 24. FIG. 1 also shows tapered area 10 and pointed end 12 having the configuration of an isosceles triangle. Although such a symmetrical configuration and lateral centering of aperture 16 within main body 4 are not critical, they are preferred for best visual reference by a golfer in accurately aiming pointed end 12 toward the flight path desired for golf ball 20. In addition, FIG. 1 shows a darkened perpendicular line 14 extending between aperture 6 and cross member 8 that gives the golfer the exact center of the golf ball 24 for club face 26 alignment prior to club/ball contact. Line 14 can also be distinguished by color, or a combination of several easily visible colors. In the alternative, darkened perpendicular line 14 can be marked only on the upper surface of main body 4, or extend downwardly across the vertical face of cross member 8.

Figure 2:
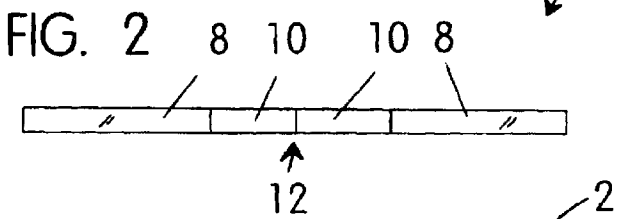
FIG. 2 is an elevational view of the pointed end of the most preferred embodiment of the present invention, with the cross member visible laterally behind the pointed end.
Figure 3:
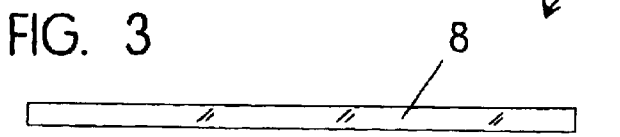
FIG. 3 is an elevational view of the end of the most preferred embodiment of the present invention having the cross member.

FIGS. 2 and 3 show the thickness dimension of plate 2 being substantially uniform throughout. FIG. 2 shows plate 2 viewed from its pointed end 12, while FIG. 3 shows the end of plate 2 having cross member 8. For durability and ease of use, the approximate one-fourth of an inch thickness dimension cited for plate 2 in the example given above is preferred for most embodiments of the present invention, even when the length and width dimensions of plate 2 respectively exceed the above-identified two-and-three-fourths and three inches. Further, FIG. 2 shows cross member 8 extending laterally beyond the sides of main body 4 in opposite directions and the opposing extensions of cross member 8 to be substantially uniform in length. Although such uniformity is preferred, the symmetrical configuration shown is not critical to the present invention as long as the golfer using it is provided with a visual reference for proper of alignment of a golf club (such as club 28 in FIG. 6) and the darkened perpendicular line 14 shown in extending between aperture 6 and cross member 8 that gives the golfer the exact center of the golf ball 24 for club face 26 alignment to achieve a center strike of golf ball 24 at the time of club/ball contact, whereby the golfer can concentrate on position and stance instead of whether a center strike will be made with golf ball 24, resulting in a straightened swing, more accurate launching of ball 24 along a desired flight path, increased distance, and fewer strokes.

Figure 4:
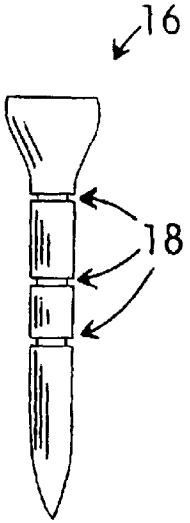
FIG. 4 is a side view of a golf tee with horizontally-extending grooves on its shaft that can be used with the plate of the most preferred embodiment of the present invention for ball height adjustment at pre-determined intervals according to the type of golf club selected for contact with the ball, the suggested size of which is a minimum of approximately two-and-one-fourth inches, or fifty-five millimeters.

FIG. 4 shows an optional golf tee 16 that can be used with plate 2 as a part of the present invention for adjustment of golf ball 24 to an optimum height for a center strike with golf club 28, more even recoil, and a more accurate launch of golf ball 24 along a desired flight path. FIG. 4 shows golf tee 16 having three spaced-apart grooves 18, with the distance between the uppermost groove 18 and the middle groove 14 being greater that the distance between the middle groove 18 and the lowest groove 18. Each groove 18 is configured to firmly snap into main body 4 as golf tee 16 is inserted through central aperture 6 in main body 4 and into the ground (not shown). However, the firmness with which each groove 18 is retained by main body 4 should not prevent tee 16 from being further inserted through main body 4 with relative ease to engage the next higher groove 18, when desired. Further, the grooves 18 shown in FIG. 4 are positioned at various heights for use with selected golf clubs 28. Although not limited thereto for every golfer, when the tee 16 used is approximately two-and-one-fourth inches in length (or approximately fifty-five millimeters), the preferred minimum length for tee 16, it is generally preferred for the uppermost groove 18 to be centered approximately nine-sixteenths of an inch from the top of golf tee 16 for use with 3-wood clubs and irons. Similarly, it is preferred for the middle groove 18 to be centered approximately one inch from the top of golf tee 16 for use with 1-wood clubs. Further, it is preferred for the lowest groove 18 to be centered approximately one-and-one-fourth inches from the top of golf tee 16 for use with jumbo clubs. The diameter of the grooved golf tee 16 shown in FIG. 4 should be configured for a snug fit within aperture 6, with little lateral movement while being used. However, the diameter of the grooved golf tee 16 shown in FIG. 4 should also be sufficiently small to allow for its easy insertion into and removal from aperture 6.

Figure 5:
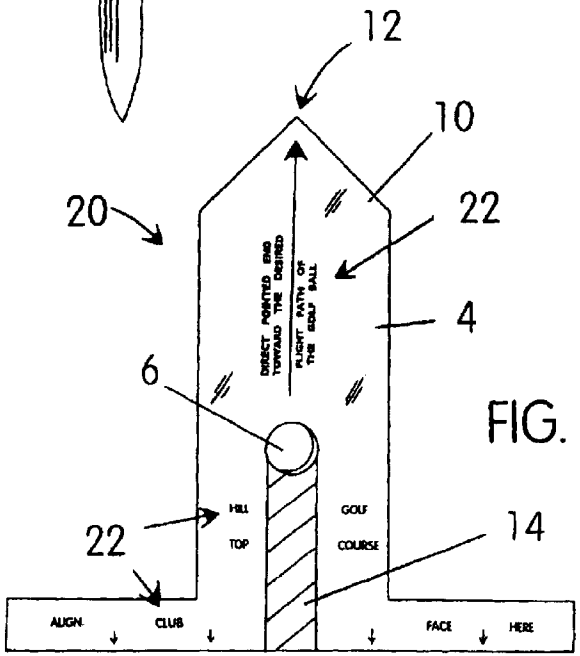
FIG. 5 is a top view of a second preferred embodiment of the present invention having an aperture extending through a central location on its plate, a pointed end that is more narrowly tapered than the pointed end of the first preferred embodiment, the cross member of the T-shaped configuration on one of the ends of the plate, the pointed end of the plate in a position opposed to its cross member, a darkened perpendicular line extending between the aperture and the cross member to indicate the exact center of the golf ball to the golfer for club face alignment prior to club/ball contact, and informational markings on the upper surface of the plate.

FIG. 5 shows a second embodiment 20 of the present invention with a tapered area 10 that has an extended and more narrowed configuration than is shown in FIG. 1. FIG. 5 also shows aperture 6 laterally centered through main body 4, and informational markings 22 on the upper surface of main body 4, tapered area 10, and cross member 8. Although not limited thereto, informational markings 22 can include arrows, circles, lines, numbers, words, instructions for use, company logos, patent and trademark information, and the like. Color enhancement can be used for informational markings 22 to provide distinctiveness where appropriate or desired. Informational markings 22 can also include images. Although not shown, information markings 22 can also be placed on the reverse side of plate 2 to provide additional company information, information related to a special promotion or cause, or for any other purpose desired by the manufacturer or distributor.

Figure 6:
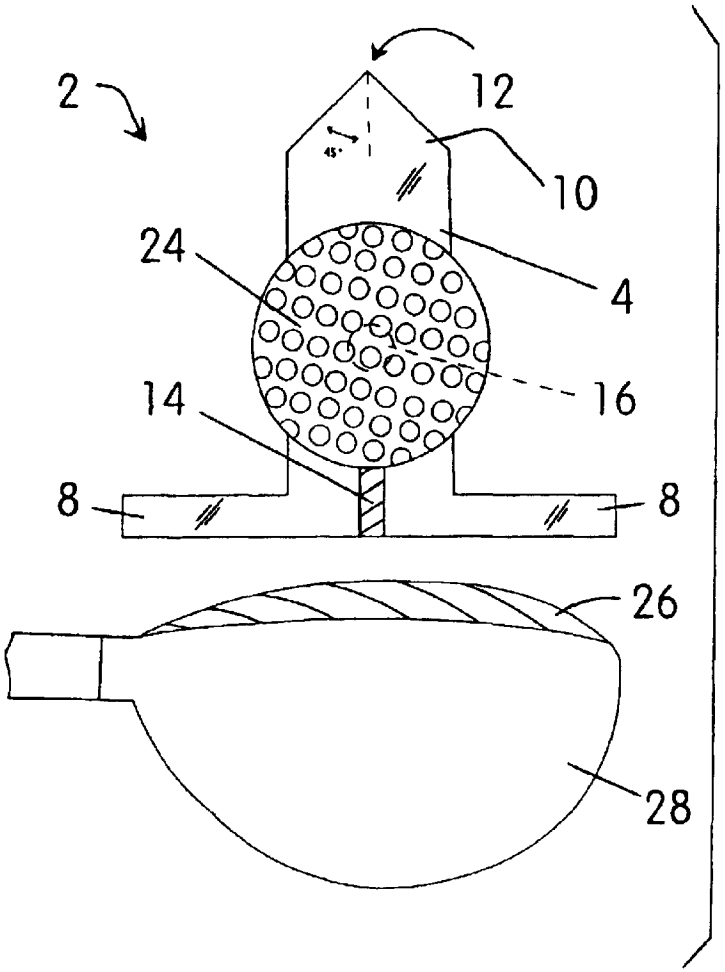
FIG. 6 is a top view of the most preferred embodiment of the present invention positioned beneath a golf ball supported by a hidden golf tee within a central aperture through its plate, a golf club aligned with the cross member prior to club/ball engagement, and a darkened line perpendicular to the cross member extending to the golf ball that gives the golfer the perfect/exact center of ball as a club face alignment reference.

FIGS. 6 and 7 show the most preferred embodiment of the present invention, previously shown in FIG. 1, with darkened perpendicular line 14 on its upper surface between aperture 6 and cross member 8. Although not shown in FIG. 7, it is contemplated for line 14 to be optionally extended down the vertical face of cross member 8. FIG. 6 shows the face 26 of a golf club 28 aligned with cross member 8 and a golf ball 24 balanced upon the top surface of hidden golf tee 16, which is laterally centered within main body 4 in aperture 6, with the darkened substantially perpendicular line 14 shown extending between aperture 6 and cross member 8 giving the golfer the exact center of golf ball 24 for club face alignment and an enhanced opportunity for a center strike of golf ball 24 when club/ball contact occurs. As can be seen in FIG. 6, the most preferred embodiment has length and width dimensions that are approximately double the diameter of golf ball 24, with golf tee 16 being positioned so that golf ball 24 extends beyond the sides of main body 4 without obscuring cross member 8, tapered area 10, pointed end 12, or line 14. In the preferred embodiment shown in FIG. 6, tapered area 10 creates an approximately 90° angle at pointed end 12. In contrast, the longer and more narrowly configured tapered area 10 shown in FIG. 5 creates an angle at pointed end 12 that is visibly less than 90°. The perpendicular orientation of line 14 relative to cross member 8 is critical. However, line 14 does not need to extend completely between aperture 6 and cross member 8, as long as a sufficient amount of line 14 is near to or in contact with cross member 8, and visible when viewed from above once golf ball 24 is placed upon tee 16 for use in prompt golfer identification of the exact center of golf ball 24. FIG. 7 shows golf ball 24 being positioned upon a tee 16 that is inserted through plate 2 between cross member 8 and tapered area 10. It is assumed that pointed end 12 is aimed at the flight path desired for golf ball 24 after being struck by a golf club, such as golf club 28 in FIG. 6, when the golf club is aligned with cross member 8 prior to club/ball contact. It is not revealed in FIG. 7 whether golf tee 16 has any grooves 18. However, if the golf tee 16 shown in FIG. 7 has multiple grooves 18, it would be the uppermost groove 18 that is seen having a snap-fit engagement with main body 4. Although not shown in FIG. 6 or 7 and even if only for aesthetic appeal, it is also considered to be within the scope of the present invention for line 14 to be extended all or part of the distance between pointed end 12 and aperture 6. Line 14 in any embodiment of the present invention may also be embellished over the simple darkened configuration shown in FIGS. 6 and 7, such as being configured as two or more closely spaced-apart lines, having one or more lines of similar or different color or lines each comprised of multiple colors, or made from one or more broken lines or a aligned sequence of other objects, such as but not limited to dots, small squares, small triangles, miniature golf tees, miniature golf balls, miniature company logos, and the like. Line 14, with or without any design or color embellishments, assists a golfer in aligning the face 26 of golf club 28 along cross member 8, or in achieving any off-center position desired for golf club 28 relative to cross member 8 to correct for inaccuracies in the golfer's swing.

To use the present invention, a golfer first needs to determine the desired flight path for golf ball 24 and select an appropriate ground location relative to that flight path for placing plate 2. The golfer then centers aperture 6 at ground level upon the selected location and aims pointed end 12 in the direction of the desired flight path. The golfer then inserts a golf tee 16 through aperture 6 and into the ground (not shown) below plate 2, after which the golf ball 24 to be launched is balanced upon tee 16. Thereafter, the golfer uses the pointed end 12 for self-alignment to the desired flight path of golf ball 24 and stands at the appropriate distance from plate 2, with golf club 28 in hand, and further uses cross member 8 and the darkened line 14 extending between aperture 6 and cross member 8, which gives the golfer the exact center of golf ball 24, to align the face of golf club 26 for a center strike with golf ball 24, whereafter the golfer can concentrate on a confident and steady swing instead of club/ball alignment. Being able to concentrate on a confident and steady swing is very important in golf. When the golfer's swing is straightened prior to striking golf ball 24, premature wrist hinge is avoided and the resulting shot is more predictable. During use, plate 2 always stays at ground level. Through the optional use of golf tees 16 having several spaced-apart grooves 14, the height of golf ball 24 can be adjusted for optimum advantage when different types of golf clubs 28 are employed to strike it.

Plate 2 can be repeatedly used during practice or during a game, and can provide assistance to golfer's of all experience and skill levels by helping them to visualize the position they must take in addressing and striking golf ball 24 to obtain greater distance and accuracy in launching ball 24 along a desired flight path. Further, by channeling the forward motion of golf club 24, the present invention corrects inaccuracies in the golfer's swing. Since the present invention is compact and placed under golf ball 24, with the outer surface of cross member 8 being used to align the face of golf club 24 and pointed end 12 providing directional assistance to the golfer for self-alignment, and the pointed end 12, cross member 8, and darkened perpendicular line 14, being in close visual proximity to golf ball 24, the golfer can concentrate on his or her swing without having to look up prior to making the swing, allowing the golfer's position and stance to remain uncompromised during the swing and resulting in a straightened swing that is more consistent in launching golf ball 24 through a desired flight path. Not having to look up prior to making a swing is very important to most golfers for preserving proper stance. Since it has a unitary construction and there is no complex set-up prior to use or dismantling between uses, the present invention is simple and efficient to use. The simple configuration also makes it cost effective to manufacture. Ease in transport between uses is facilitated by the small size of plate 2, typically having maximum length and width dimensions of approximately three inches, as well as its ability to be manufactured from lightweight materials such as plastic. Further the materials from which plate 2 is made are rugged, durable, unaffected by contact with moisture and vegetation, and require little or no maintenance between uses other than cleaning when ground surfaces are damp for reuse or storage in a golf bag or pocket.

I claim:

1. A simple and compact reusable directional golf tee apparatus having three related purposes, first to align a golfer to the desired flight path of his/her golf ball, second to position the face of the golfer's club to the intended direction of the ball, and third to give the golfer a reference for the exact center of the golf ball so that users of all skill levels can better visualize the position they must take in addressing and striking a golf ball to obtain greater distance and accuracy in launching the ball along a desired flight path, said apparatus comprising:

a substantially planar and substantially T-shaped plate configured for use at ground level and having opposing ends, with the cross member of its T-shaped configuration located at one of said opposing ends, the other of said opposing ends having a configuration that tapers to a point;

an aperture extending through said plate in a central location, said aperture being configured and dimensioned for insertion of a golf tee; and a darkened substantially perpendicular line extending between said aperture and said cross member whereby when a golfer places said plate at ground level with said point directed toward the desired flight path of a golf ball, inserts a golf tee through said aperture in said plate and partially into the ground, and positions the golf ball upon the golf tee, the golfer can align the face of a golf club against said cross member to better visualize the position that must take in addressing and striking the golf ball to obtain greater distance and accuracy in launching the golf along the desired flight path.

2. The apparatus of claim 1 wherein said T-shaped plate has an upper surface, and further comprising an extension of said line between said aperture and said pointed end.

3. The apparatus of claim 1 wherein said plate has maximum length and width dimensions of approximately three inches.

4. The apparatus of claim 1 wherein said T-shaped plate has an upper surface and further comprising informational markings on said upper surface.

5. The apparatus of claim 4 wherein said informational markings at least in part provide instructions for use of said apparatus.

6. The apparatus of claim 1 wherein said T-shaped plate has an upper surface and said aperture has a center, and further comprising an arrow marked onto said upper surface between said aperture and the one of said opposing ends that tapers to a point, said arrow being substantially aligned with said point and said center.

7. The apparatus of claim 1 wherein said T-shaped plate is made from materials selected from a group consisting of durable materials, lightweight materials, and plastic.

8. A method for using the apparatus in claim 1 to align a golfer to the desired flight path of his or her golf ball, to position the face of the golfer's club to the intended direction of the ball, and to give the golfer the exact center point of the golf ball as a reference so that users of all skill levels can better visualize the position they must take in addressing and striking a golf ball to obtain greater distance and accuracy in launching the ball along a desired flight path, said method comprising the steps of:

providing one said apparatus of claim 1, a golf tee, a golf ball, and a golf club;

determining the desired flight path for said ball;

selecting an appropriate ground location relative to said desired flight path for placing said apparatus;

placing said apparatus upon said ground location so that said aperture through said T-shaped plate is centered upon said ground location while said pointed end of said T-shaped plate is concurrently aimed in the direction of the desired flight path;

inserting a tee through said aperture in said T-shaped plate and partially into the ground below said T-shaped plate;

placing said golf ball upon said tee;

aligning said golf club with said cross member; and using said darkened perpendicular line to center the face of the club head of said golf club to the exact center of said golf ball whereby since the golfer does not have to look up prior to swinging said golf club to look at the desired flight path of the ball and club/ball alignment, the golfer's position and stance are not compromised during the swing, resulting in a straightened swing that is more consistent in launching said golf ball through the intended flight path.

9. The method of claim 8 wherein said tee is selected from a group consisting of tees having a standard size length dimension, tees having a shaft with a plurality of spaced-apart grooves thereon and each said groove being configured for engagement with said aperture through said T-shaped plate, and tees having a shaft dimension longer than standard sized tees.

10. The method of claim 9 further comprising a plurality of additional golf clubs, and wherein each of said grooves is positioned for use with a different one of said golf clubs so that a center strike of the launched golf ball can be more consistently achieved, producing more even ball recoil and a more predictable shot.

11. The method of claim 8 wherein said T-shaped plate has an upper surface and an extension of said darkened line marked onto said upper surface between said aperture and said pointed end, and further comprising a step after said step of aligning said golf club with said cross member wherein the golfer centers the face of said golf club with said darkened line and said line extension.

12. The method of claim 8 wherein said T-shaped plate is made from materials selected from a group consisting of durable materials, lightweight materials, and plastic, and further wherein said plate has maximum length and width dimensions of approximately three inches and said golf tee has a minimum length dimension of approximately two-and-one-fourth inches.

13. The method of claim 8 wherein said T-shaped plate has an upper surface and further comprising informational markings on said upper surface that at least in part provide instructions for use of said apparatus, and further comprising the step of using said instructions for use to assist a golfer in orientation of said apparatus and said golf club relative to the desired flight path of said golf ball.

14. A method for using said apparatus of claim 1 for aligning a golfer's club in a manner that ensures a confident and steady swing and prevents premature wrist hinge, said method comprising the steps of:

providing one said apparatus of claim 1, a golf tee, a golf ball, and a golf club;

determining the desired flight path for said ball;

selecting a ground location for said apparatus that is appropriate to said desired flight path and under the anticipated point of contact between said golf ball and said golf club once said golf club is swung;

placing said T-shaped plate on said ground location at a spaced-apart distance in front of the golfer's feet with said aperture positioned under said anticipated point of contact between said golf ball and said golf club, with said pointed end of said T-shaped plate directed toward the intended flight path of said golf ball and said cross member oriented toward the direction from which said golf club will be swung;

inserting said golf tee through said aperture and into the ground below said T-shaped plate;

balancing said golf ball upon said tee;

using said cross member to align the face of said golf club; and using said darkened perpendicular line to center the face of the club head of said golf club to the exact center of said golf ball whereby the golfer is able to rely on said tapered end of said T-shaped plate, said cross member, and said darkened line for directional assistance in self-alignment relative to the desired flight path of said golf ball and since the golfer does not have to look up prior to swinging said golf club to look at the desired flight path of the ball and club/ball alignment, the golfer's position and stance are not compromised during the swing, resulting in a straightened swing that is more consistent in launching said golf ball through the intended flight path.

15. The method of claim 14 wherein said tee is selected from a group consisting of tees having a standard size length dimension, tees having a shaft with a plurality of spaced-apart grooves thereon and each said groove being configured for engagement with said aperture through said T-shaped plate, and tees having a shaft dimension longer than standard sized tees.

16. The method of claim 15 further comprising a plurality of additional golf clubs, and wherein each of said grooves is positioned for use with a different one of said golf clubs so that a center strike of the launched golf ball can be more consistently achieved, producing more even ball recoil and a more predictable shot.

17. The method of claim 14 wherein said T-shaped plate has an upper surface and an extension of said line segment marked onto said upper surface between said aperture and said pointed end, and further comprising a step after said step of aligning said golf club with said cross member wherein the golfer centers the face of said golf club with said darkened line and said line extension.

18. The method of claim 14 wherein said T-shaped plate is made from materials selected from a group consisting of durable materials, lightweight materials, and plastic.

19. The method of claim 14 wherein said T-shaped plate has an upper surface and further comprising informational markings on said upper surface that at least in part provide instructions for use of said apparatus, and further comprising the step of using said instructions for use to assist a golfer in orientation of said apparatus and said golf club relative to the desired flight path of said golf ball.

20. The method of claim 14 wherein said plate has maximum length and width dimensions of approximately three inches and said golf tee has a minimum length dimension of approximately two-and-one-fourth inches.

* * * * *